US009162734B2

(12) United States Patent
Tomas et al.

(10) Patent No.: US 9,162,734 B2
(45) Date of Patent: Oct. 20, 2015

(54) METHOD OF INSTALLING A BUOY AND APPARATUS FOR TENSIONING A BUOY TO AN ANCHORING LOCATION

(75) Inventors: Julek Romuald Tomas, Aberdeen (GB); Arnbjorn Joensen, Aberdeen (GB)

(73) Assignee: Subsea 7 Limited, Sutton (GB)

( * ) Notice: Subject to any disclaimer, the term of this patent is extended or adjusted under 35 U.S.C. 154(b) by 74 days.

(21) Appl. No.: 13/635,359

(22) PCT Filed: Jun. 28, 2011

(86) PCT No.: PCT/GB2011/051223

§ 371 (c)(1), (2), (4) Date: Jun. 24, 2013

(87) PCT Pub. No.: WO2012/001406

PCT Pub. Date: Jan. 5, 2012

(65) Prior Publication Data

US 2013/0295802 A1 Nov. 7, 2013

(30) Foreign Application Priority Data

Jun. 29, 2010 (GB) ..... 1010874.4

(51) Int. Cl.

| | |
|---|---|
| ***E02B 17/08*** | (2006.01) |
| ***B63B 22/02*** | (2006.01) |
| ***B63B 21/00*** | (2006.01) |
| ***B63B 21/50*** | (2006.01) |
| ***B63B 22/18*** | (2006.01) |

(52) U.S. Cl.

CPC ..... *B63B 22/021* (2013.01); *B63B 21/00* (2013.01); *B63B 21/502* (2013.01); *B63B 22/18* (2013.01); *B63B 2021/003* (2013.01)

(58) Field of Classification Search

CPC ..... B63B 2035/442

USPC ..... 405/203, 205, 209, 223.1, 224, 195.1; 441/3–5; 114/230.1

See application file for complete search history.

(56) References Cited

U.S. PATENT DOCUMENTS

| | | | | |
|---|---|---|---|---|
| 4,281,613 | A * | 8/1981 | Ray et al. | 114/230.23 |
| 4,632,663 | A | 12/1986 | Kiely et al. | |
| 5,364,075 | A | 11/1994 | Montgomery | |
| 5,707,178 | A * | 1/1998 | Srinivasan | 405/223.1 |
| 6,564,740 | B1 | 5/2003 | Hobdy et al. | |
| 7,513,208 | B1 | 4/2009 | Seaman et al. | |
| 2006/0056918 | A1 | 3/2006 | Luppi | |

FOREIGN PATENT DOCUMENTS

| | | |
|---|---|---|
| EP | 0349267 | 1/1990 |
| FR | 2 417 005 | 9/1979 |
| FR | 2 839 110 | 10/2003 |
| GB | 2 283 956 | 5/1995 |

(Continued)

*Primary Examiner* — Sean Andrish

(74) *Attorney, Agent, or Firm* — Levy & Grandinetti

(57) ABSTRACT

A method of installing a production buoy at a subsea anchoring location is disclosed. The method includes floating a production buoy over a subsea anchoring location. Then, hanging at least a tether off the production buoy such that the or each tether extends from the production buoy towards the subsea anchoring location occurs. The method includes submerging the production buoy to a depth which allows connection of the or each tether to the subsea anchoring location. An apparatus suitable for use with this method is also provided.

14 Claims, 15 Drawing Sheets

(56) References Cited

FOREIGN PATENT DOCUMENTS

| | | |
|---|---|---|
| GB | 2 295 408 | 5/1996 |
| GB | 2 417 011 | 2/2006 |
| WO | WO 96/30253 | 10/1996 |
| WO | WO 98/24686 | 6/1998 |
| WO | WO2010/052422 | 5/2010 |

* cited by examiner

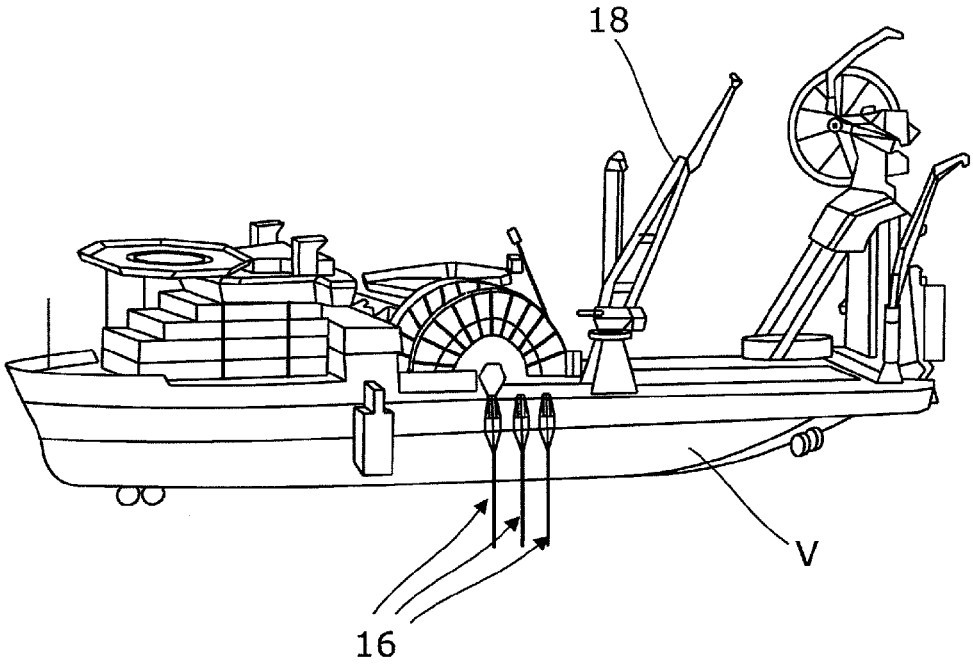
Fig. 7
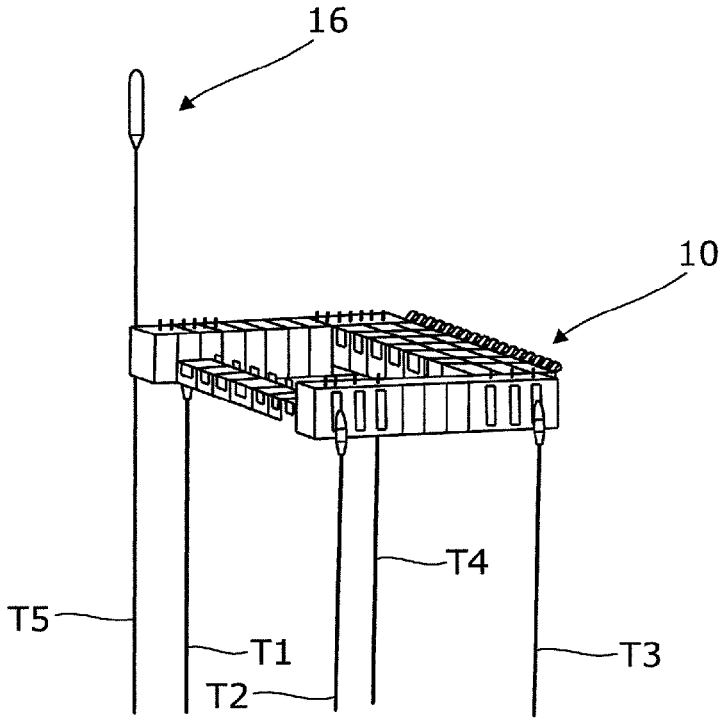

METHOD OF INSTALLING A BUOY AND APPARATUS FOR TENSIONING A BUOY TO AN ANCHORING LOCATION

This Application is the U.S. National Phase of International Application Number PCT/GB2011/051223 filed on Jun. 28, 2011, which claims priority to Great Britain Application Number 1010874.4 filed on Jun. 29, 2010.

BACKGROUND OF THE INVENTION

The present invention relates to a method of installing a buoy, particularly, but not exclusively, a subsea production buoy used in deep water hydrocarbon production facilities employing hybrid riser configurations. The invention also provides apparatus for tensioning a subsea production buoy to an anchoring location, particularly, but not exclusively, an anchoring location provided on a subsea foundation.

In deep water production fields, rather than installing a fixed production platform, it is common to anchor a floating production, storage and offloading (FPSO) vessel at a suitable surface location near the field. The produced fluids are recovered from the subsea well(s) to the seabed and then carried along pipelines laid on the seabed to the FPSO. The fluids are processed and stored on the FPSO before being transported, normally by tanker, to an onshore facility for further processing/distribution.

The connection between the pipeline laid on the seabed and the FPSO is typically provided by a steel catenary riser (SCR). The SCR is suspended in the water in axial tension by a subsea buoy tethered to the seabed. With such an arrangement, the SCR extends only from the subsea pipeline to the subsea buoy where it is coupled, through a suitable connection, to a flexible riser. The flexible riser then hangs between the subsea buoy and the FPSO. This connection system is sometimes called a "de-coupled system". Here the heave motions of the surface vessel are de-coupled from the subsea buoy motions and thus the SCRs hanging from it.

To meet operational requirements, it is important that such subsea buoys are maintained at an appropriate depth and at an appropriate location in the water. This can be problematic due to the large distance between the surface and the foundation to which the buoy is to be anchored.

Another problem is that localised water currents require that the tethers extend from the buoy to the anchoring location at a varying angle. If handled incorrectly, this can cause localised areas of excessive force on the tethers adjacent the connections with the buoy, which can in turn lead to premature failure of the tethers.

BRIEF SUMMARY OF THE INVENTION

According to a first aspect of the present invention, there is provided a method of installing a production buoy at a subsea anchoring location, the method comprising the steps of:— floating a production buoy over a subsea anchoring location;

hanging at least a tether off the production buoy such that the or each tether extends from the production buoy towards the subsea anchoring location; and submerging the production buoy to a depth which allows connection of the or each tether to the subsea anchoring location.

Optionally, the step of submerging the production buoy comprises the step of submerging the production buoy to a first predetermined depth prior to hanging the or each tether off the production buoy.

The step of submerging the production buoy may comprise suspending a chain with clump weights from a pair of vessels attached to either side of the production buoy.

Optionally, the production buoy comprises a square or rectangular shape and four tethers are hung off the production buoy, one at each corner of the production buoy. Alternatively, the production buoy comprises a triangular shape and three tethers are hung off the production buoy, one at each corner of the production buoy; this triangular shape may provide improved design kinematics.

The step of securing the or each tether to the subsea anchoring location may comprise tilting the production buoy to one side in order to secure a pair of tethers at one side of the production buoy to corresponding subsea anchoring foundations at that side of the production buoy, and then tilting the production buoy to the other side in order to secure a pair of tethers at the other side of the production buoy to corresponding subsea anchoring foundations at that side of the production buoy.

Optionally, the step of tilting the production buoy is performed by lowering the chain and clump weights further from a vessel attached to one side of the production buoy and then from the other vessel attached to the other side of the production buoy. Alternatively, the step of tilting the buoy is performed by selective flooding of ballast compartments within the buoy.

Optionally, the method further comprises attaching the production buoy to the subsea anchoring location with at least a further tether. Optionally, the method comprises attaching the production buoy to the subsea anchoring location with a further four tethers for a square or rectangular buoy or a further three tethers for a triangular buoy.

The step of attaching the production buoy to the subsea anchoring location with at least a further tether may comprise the step of lowering the or each further tether until the lower end of the or each tether is adjacent the anchoring location, and an attachment portion, such as a tensioning module, toward the upper end of the tether is adjacent the production buoy, and then attaching the lower end to the anchoring location and the attachment portion to the production buoy. The step of lowering optionally includes lowering the or each further tether from a crane provided on a support vessel.

Optionally, the method of installing the buoy further comprises the step of providing tensioning apparatus between the production buoy and the subsea anchoring location. Optionally, the step of providing the tensioning apparatus comprises attaching a support bracket of the tensioning apparatus to the production buoy, securing the tether with respect to the tensioning apparatus with a tether holding arrangement, providing a pivotable articulating member having a tether receiving channel therethrough, the receiving channel having a longitudinal axis aligned with a tether departure axis, and a support socket adapted to pivotably receive the pivotable articulating member such that movement of the tether departure axis out of alignment with the receiving channel longitudinal axis results in corresponding pivotal movement of the pivotable articulating member with respect to the socket.

The method of installing the buoy may comprise the steps of selectively actuating the or each tensioning apparatus in order to incrementally adjust the tension held by the or each tether. Optionally, the method comprises substantially equalising the tension held by each tether.

According to a second aspect of the present invention, there is provided tensioning apparatus for tensioning a tether extending between a first structure and second structure, the tensioning apparatus comprising:

a support bracket for attaching the apparatus with respect to the first structure;

a tether holding arrangement for securing the tether with respect to the apparatus;

a pivotable articulating member having a tether receiving channel therethrough, the receiving channel having a longitudinal axis substantially aligned with a tether departure axis, and a support socket adapted to pivotably receive the pivotable articulating member such that movement of the tether departure axis away from alignment with the receiving channel longitudinal axis results in corresponding pivotal movement of the pivotable articulating member with respect to the socket.

Optionally, the first structure is a subsea production buoy and the second structure is a subsea anchoring location.

Optionally, the pivotable articulating member and the support socket are adapted to allow pivotable movement of the apparatus in any direction around a pivot point in order to adjust for corresponding movement of the tether departure axis. Optionally, the pivotable articulating member and the support socket comprise a ball and socket arrangement.

The pivotable articulating member may be provided with an elongated extension to facilitate movement of the pivotable articulating member with the tether departure axis. Optionally, the tether holding arrangement is provided at the lower end of the elongated alignment extension. This provides a greater moment force at the interface between the pivotable articulating member and the support socket as the tether departure axis tends to move away from alignment with the receiving channel longitudinal axis.

The tether holding arrangement may comprise a pair of locking dogs adapted to engage with chain sections of the tether. The pair of locking dogs may be powered to allow them to open and close independently. This allows lengthening of the tether.

Removable bearing pads may be provided between the pivotable articulating member and the support socket. Bearing surfaces of the bearing pads or the pivotable articulating member and/or the support socket may be provided with a low friction coating to facilitate movement relative to each other. The material of the bearing surfaces may also be adapted to minimise wear over the lifetime of the apparatus.

Optionally, a bearing sheave may be provided above the pivotable articulating member in order to control a collected portion of the tether having passed through the pivotable articulating member. Optionally, the bearing sheave is provided on an elongated extension arm.

The pivotable articulating member may be provided with a jack attachment plate adapted to allow connection to a linear jack.

The tensioning apparatus may also be provided with a strain gauge to monitor tension in the attached tether. Optionally, the strain gauge is integrated with the bearing pads.

BRIEF DESCRIPTION OF THE DRAWINGS

Embodiments of the present invention will now be described, by way of example only, with reference to the accompanying drawings, in which:—

FIG. 7 is a schematic perspective view of a fifth tether and associated tensioning apparatus being deployed from the support vessel;

DETAILED DESCRIPTION OF THE INVENTION

Initial Deployment and Tethering of Buoy to Foundations

Referring to FIGS. 1 to 6, the initial steps involved in installing a subsea buoy 10 at an appropriate sea bed location will be described. At the end of this first deployment phase, the buoy will be tethered to four subsea foundations by four tethers.

Figure 1:
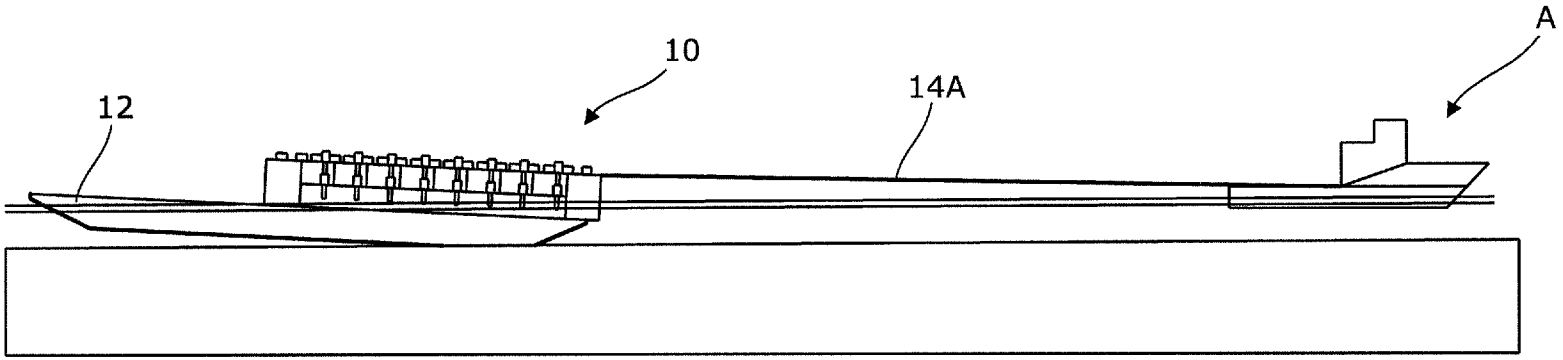
FIG. 1 is a schematic side view of an anchor handling tug towing the buoy off of a floating barge.
Figure 2:
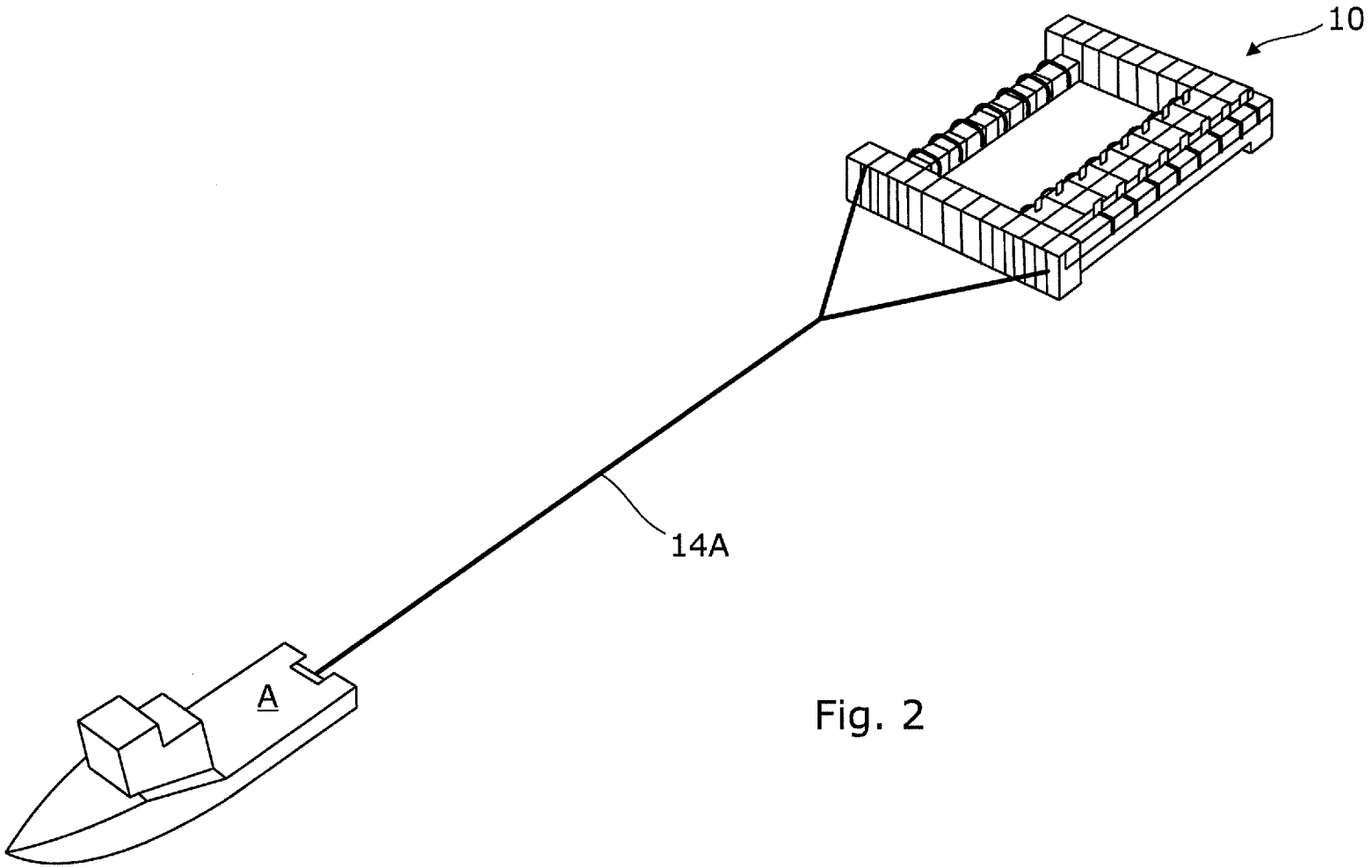
FIG. 2 is a schematic perspective view of the anchor handling tug towing the floating buoy to the desired surface location for subsequent submersion.

As shown in FIG. 1, the buoy 10 is initially stored on a floating barge 12. A first tug A is attached to a suitable towing point on the buoy 10 with chain 14A. Tug A is driven forward to pull the buoy 10 off the barge 12 and onto the surface of the water. Referring to FIG. 2, tug A then tows the buoy 10 to the required surface location.

Figure 3:
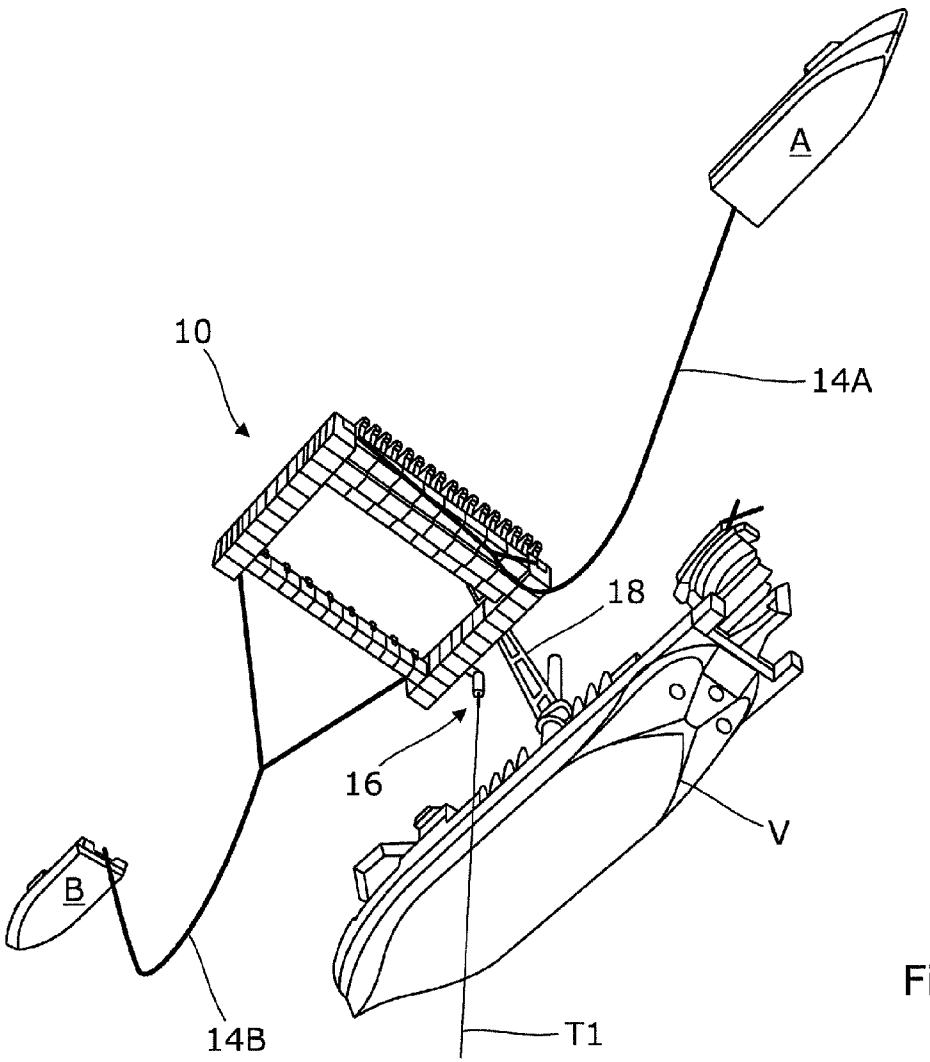
FIG. 3 is a schematic underside view of the buoy prior to submersion. A pair of anchor handling tugs are connected to the buoy which is located alongside a support vessel.
Figure 4:
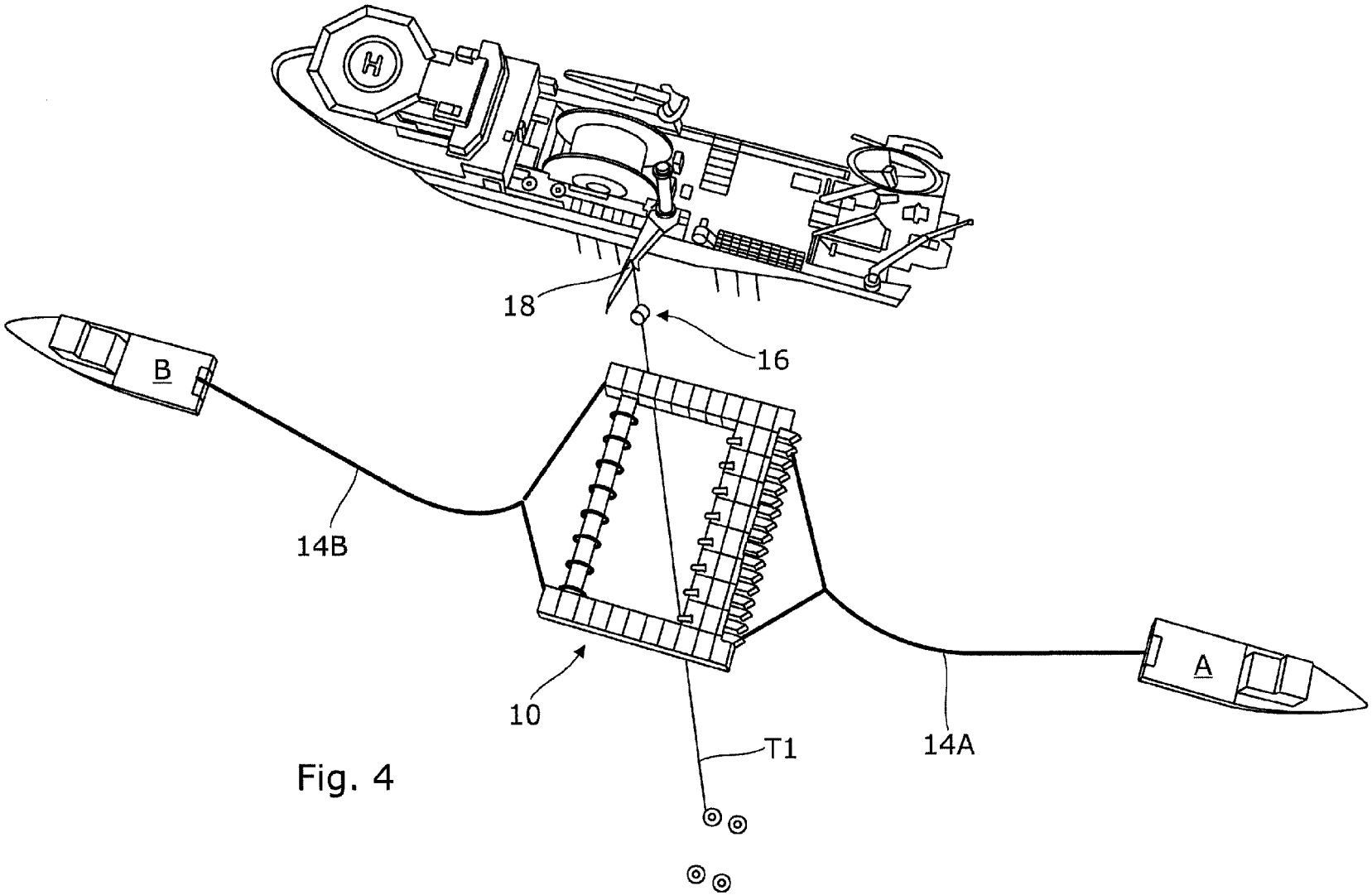
FIG. 4 is a schematic overhead view of the arrangement of FIG. 3.

As shown in FIG. 3, once at the required surface location, tug B is then attached to the opposite side of the buoy 10 with chain 14B such that the buoy 10 is floating on the surface between the two tugs A and B. The tugs A and B and buoy 10 are adjacent a support vessel V.

Tether T1 and an associated tensioning apparatus 16 (to be described in detail subsequently) are then hoisted from the vessel V by a crane 18 such that the tether T1 is suspended from a corner of the buoy 10. This is repeated three more times for tethers T2, T3, and T4 until the four tethers are suspended from the four corners of the buoy 10. At this point, a short length of the chains 14A and 14B are in the water. Chain clump weights (not shown) are located on the decks of the tugs A and B.

The buoy 10 is provided with certain ballast compartments (approximately 15-20% of the total buoy 10 displacement) that will have enough displacement to float the weight of the buoy 10 plus four tethers T1 to T4, with some reserve buoyancy. All remaining compartments are flooded. These ballast compartments are designed to withstand internal or external over pressure (approximately 5-6 bars). Drop down hoses are fitted to the ballast compartments in order to ensure, before commencing each lowering step, an internal over pressure (2-3 bars) exists. The remaining compartments (approximately 80-85%) will be designed to withstand approximately 3 bar of internal or external over pressure in order to cope with any pressure variations. The displacement of these compartments will provide the buoyancy to carry the entire payload (production fluids, SCR's, tether and flexible weights) as well as the tether tensions. During installation of the buoy 10 these compartments will be fully open to the sea to avoid any damage due to excessive hydrostatic pressure differential.

In order to begin submerging the buoy 10 and attached tethers T1 to T4, the tugs A and B begin to slowly pay out more chain 14A and 14B until a series of clump weights 20 (FIG. 6) are deployed off the rear of their decks and into the water. The chains 14A, 14B are then paid out further on working wires 15A, 15B connected thereto. As a greater and greater length of working wire 15A, 15B is deployed, more and more of the clump weights 20 will be suspended by the buoy 10 rather than the tugs A and B. Eventually the combined weight suspended from the buoy 10 will be in balance with the buoyancy of the buoy 10. The buoy 10 will slowly start to submerge.

A short time should then be allowed to pass with the buoy 10 submerged just below the surface, without paying out more working wire 15A, 15B from the tugs A, B. This allows all low pressure compartments in the buoy 10 to fully flood ensuring no air bubbles are present.

A remotely operated vehicle (ROV) can be used, if required, to inspect "clump weight markings" in order to confirm the buoy 10 buoyancy and thereby determine that all low pressure compartments of the buoy 10 are fully flooded. This is done by identifying (approximately) the lowest link in the clump weights 20, which will inherently correspond to the weight of the clump weight 20 and chain being carried solely by the buoy 10.

The tugs A, B can then continue to pay out wire 15A, 15B in incremental steps of approximately 20-30 m in order to incrementally lower the buoy 10 until it is positioned at approximately the required operational depth below the surface.

Figure 5:
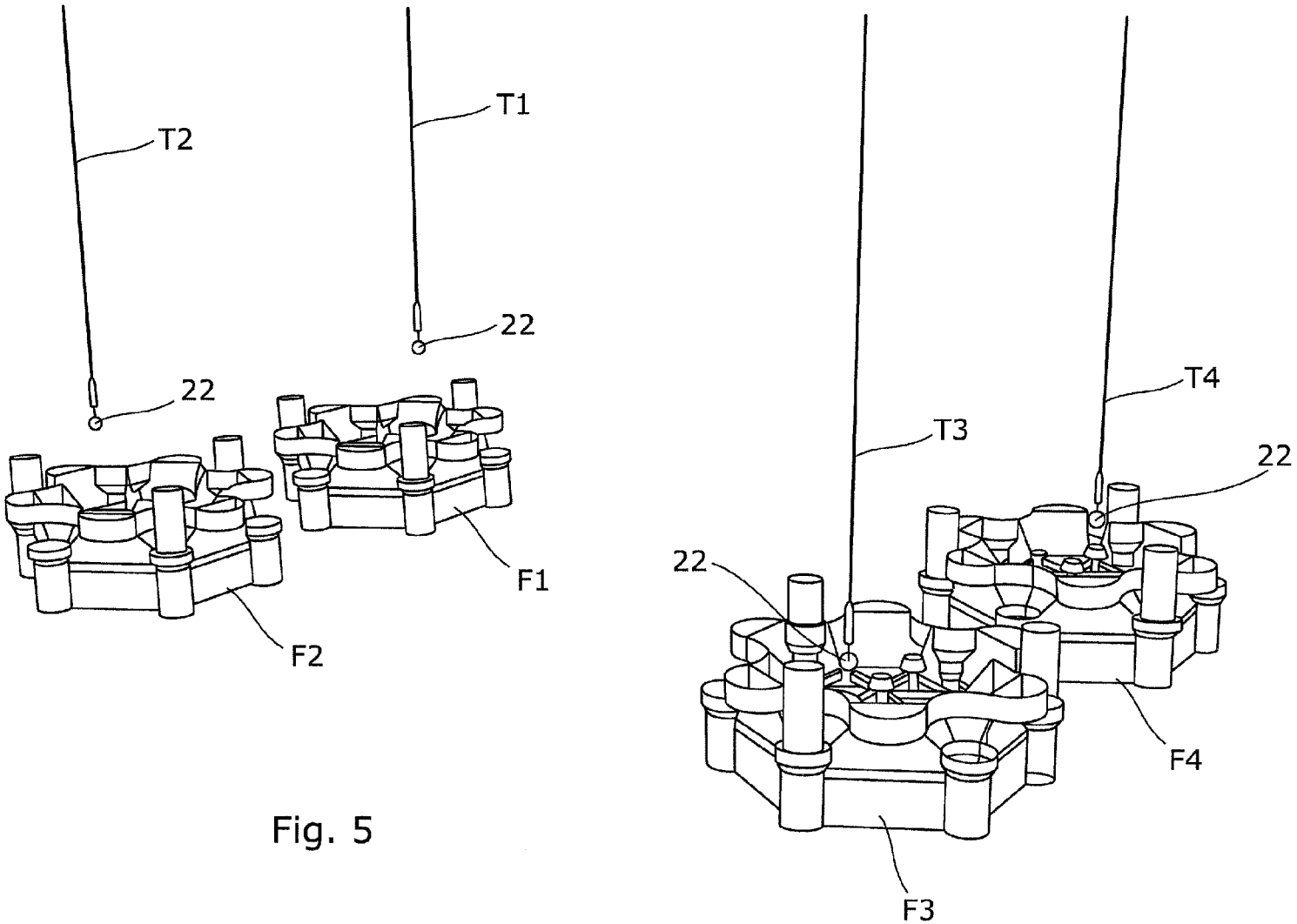
FIG. 5 is a schematic perspective view of the first four tethers approaching foundations provided at the sea bed below the buoy.
Figure 6:
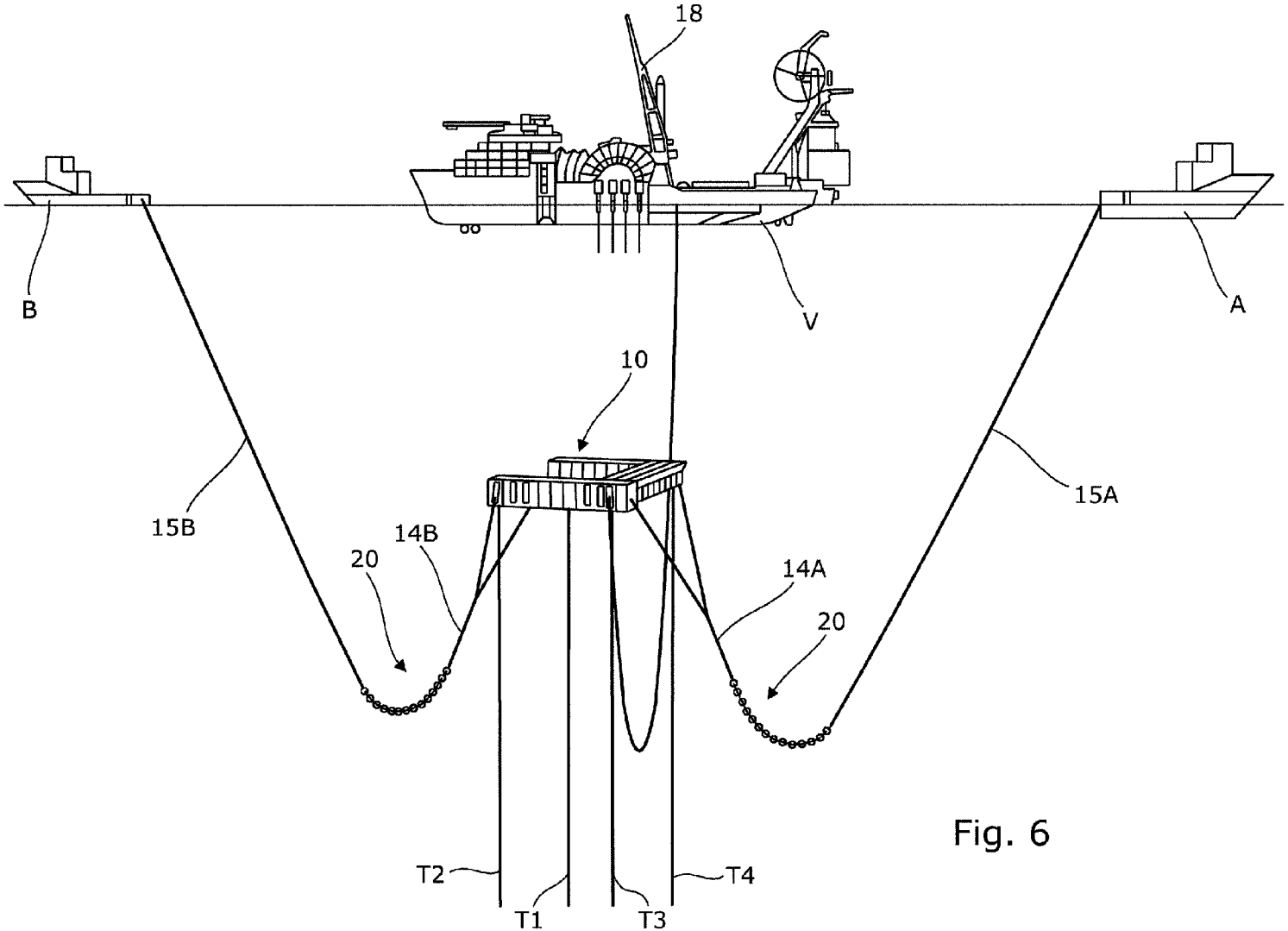
FIG. 6 is a schematic side view of the submerged buoy tethered to the foundations by the first four tethers, prior to detachment from the anchor handling tugs.

Referring to FIG. 5, this incremental submersion is continued until the foundation connectors 22 of the tethers T1, T2, T3, T4 are located approximately 5-10 m above the seabed. The tugs A and B are then manoeuvred until the connectors 22 are aligned with suitable anchoring locations on subsea foundations F1, F2, F3, F4.

Mating of the connectors 22 with the foundations F1 to F4 is performed by tilting the buoy 10. Tilting is achieved by paying out the work wire 15A from tug A by a relatively small amount until more weight is suspended from that side of the buoy 10 than from the other side of the buoy 10. This lowers the buoy 10 at that side, while tug B maintains the same length of deployed working wire 14A, and hence buoy height, at its side.

Once this side of the buoy 10 has been sufficiently tilted, the connectors 22 of tethers T3 and T4 are close enough to dock with a corresponding connector interface on the foundations F3 and F4. If required, an ROV may be used to assist with any small adjustments in the position of the tethers T3 and T4 so that they can be secured to the foundations F3 and F4.

With both tethers T3 and T4 secured to the foundations F3 and F4, the tug A then hauls in the work wire 15A until the tethers T3 and T4 take a portion of the buoyant load of the buoy 10 away from chain 14A.

Tug A is now held stationary. Tug B then pays out work wire 15B in order to lower that side of the buoy 10. Tug B continues to pay out working wire 15B until the foundation connectors 22 of tethers T1 and T2 are close enough to dock with foundations F1 and F2 in a similar fashion as previously described for tethers T3 and T4. Now, with both tethers T1 and T2 secured to the foundations F1 and F2, and both tethers T3 and T4 secured to the foundations F3 and F4, the tug B then hauls in the work wire 15B until the tethers T1 and T2 take a portion of buoyant load of the buoy 10 away from chain 14B.

All four corners of the buoy 10 are now secured to foundations F1 to F4 by tethers T1 to T4 respectively. The tugs A and B now haul in their work wires 15A, 15B until the buoyant load of the buoy 10 is retained only by the tethers T1 to T4. The tugs A and B can now be disconnected from the buoy 10 and recover their chain clump weights 20, and chains 14A, 14B to their respective decks.

Installation of Remaining Four Tethers

Referring to FIG. 7, the buoy 10 is now retained by the first four tethers T1 to T4 (one in each corner). In order to accommodate the weight of the following extra four tethers T5 to T8, the buoy 10 may be appropriately de-ballasted (by for example, approximately 600 t; 200 t on each existing tether) prior to the second phase where the remaining four tethers are installed. Spare buoyancy may also be provided (for example, approximately 50 t on each existing tether).

An array of the remaining tensioning modules 16 is provided at the side of the vessel V. A foundation connector 22 and depth beacon (not shown) is attached to the first end of each tether prior to deployment from the vessel V. The tether is then passed overboard from the vessel V and paid out until the upper end of the tether is off the reel and on the deck of the vessel V. The length of the tether passed into the water can be monitored using the depth beacon.

A top chain 48 (discussed below in more detail) on the tensioning module 16 is adjusted to ensure there will be ample slack during connection to the foundations F1 to F4 and the buoy 10. The top of the tether is then attached to the top chain 48 and connected to the tensioning module 16 and linear jacks 42. In this way, the remaining tethers T5 to T8 can be deployed.

Figure 8:
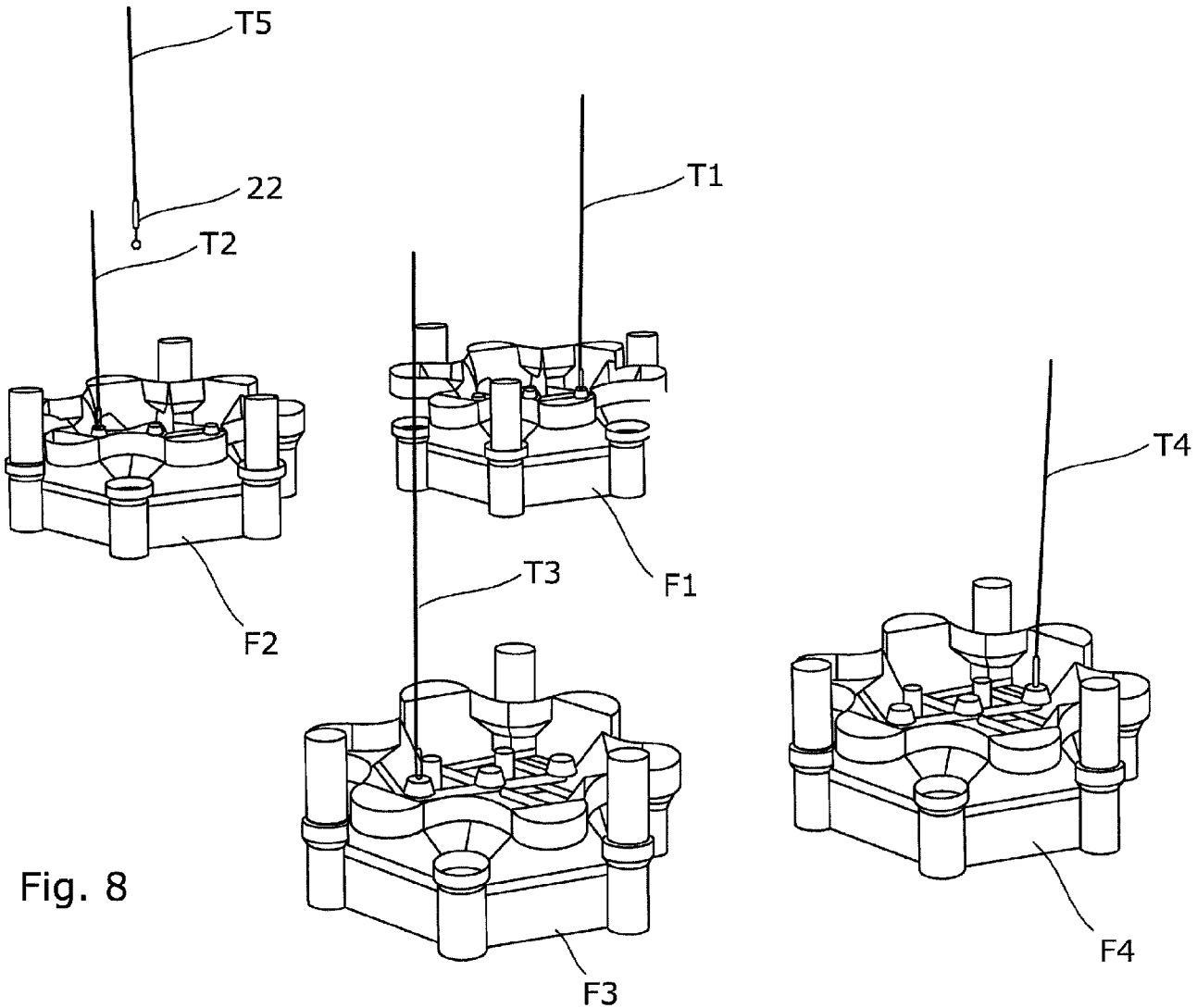
FIG. 8 is a schematic perspective view of the fifth tether approaching the foundations provided at the sea bed below the buoy.

To deploy tether T5, for example, the crane 18 is attached to the tensioning module 16 and takes the load of the tether T5. The crane 18 is then manoeuvred until the load has cleared the side of the vessel V. The tether T5 and associated tensioning module 16 is now lowered by the crane 18 until foundation connector 22 is a few meters above the seabed (see FIG. 8). The vessel V and/or crane 18 are now manoeuvred, if required, until the foundation connector 22 is close to the required foundation; in this case foundation F2.

The tether T5 is now paid out further until foundation connector 22 docks with the foundation (again, an ROV may be used to facilitate docking).

Figure 12:
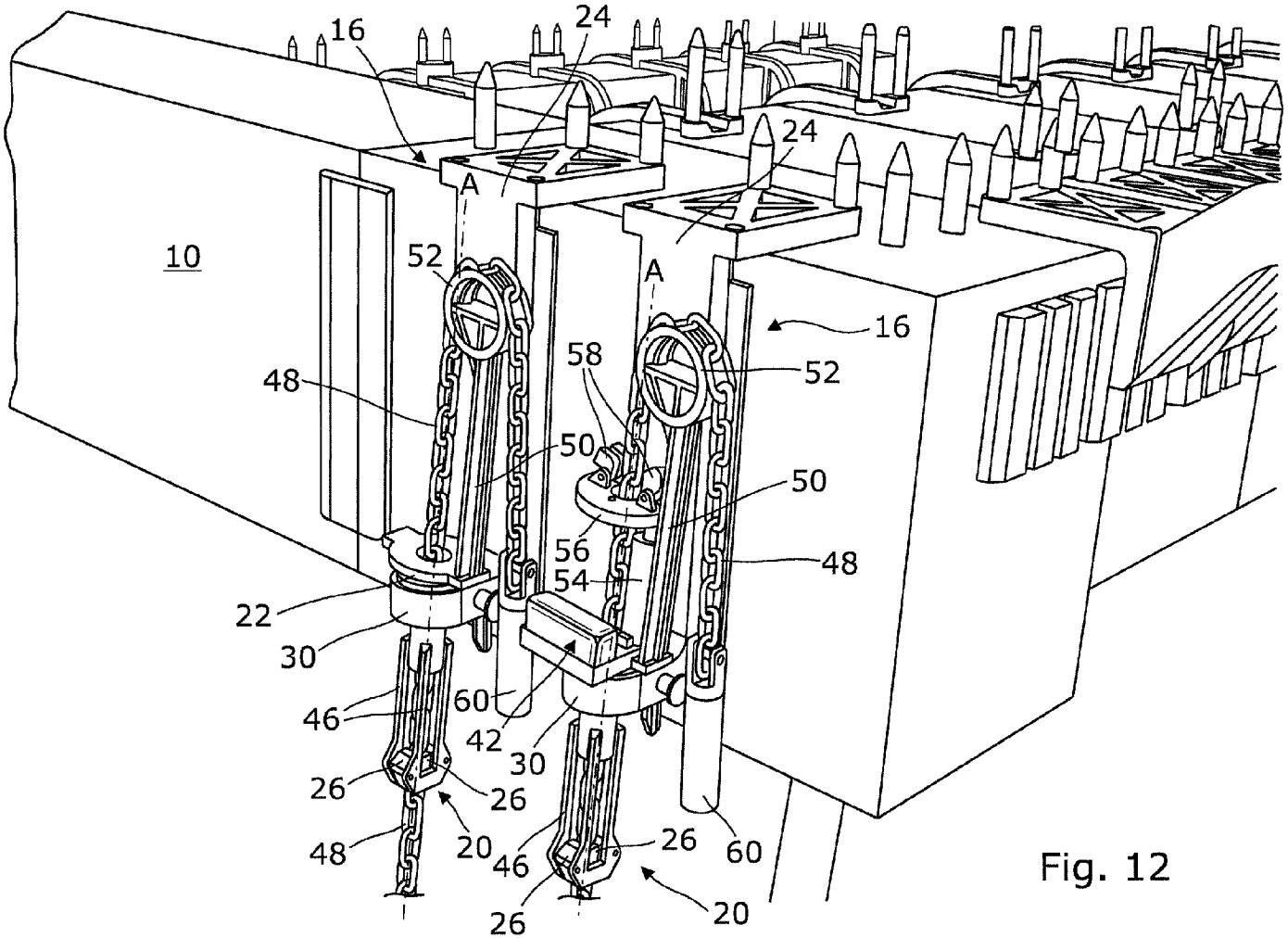
FIG. 12 is a perspective view of two tensioning apparatus mounted at a corner of the buoy 10.
Figure 13:
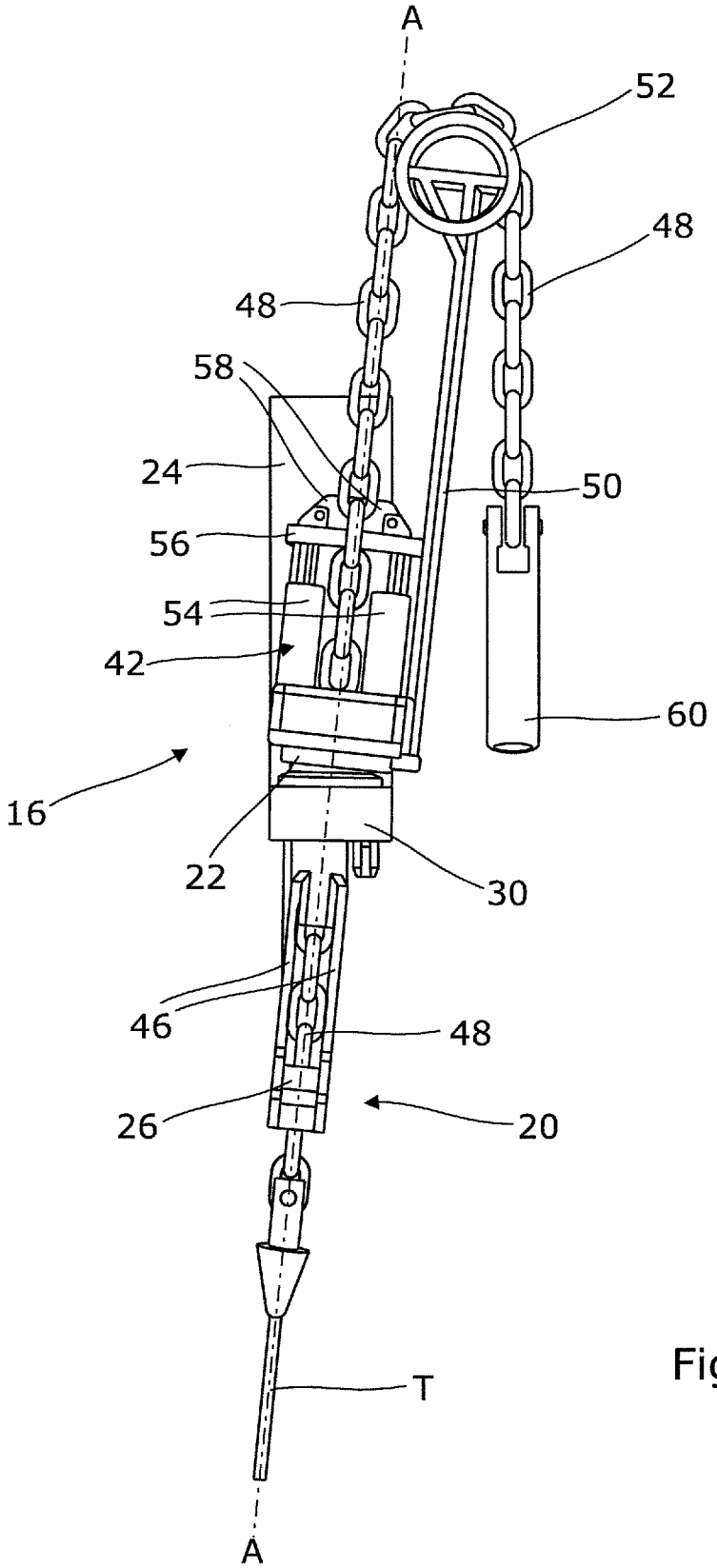
FIG. 13 is a front view of the tensioning apparatus of FIG. 10 with an inclined tether departure axis A-A.

At the upper end of the tether T5, the vessel V and/or the crane 18 is then manoeuvred to allow mating of the tensioning module 16 with the buoy 10. As shown in FIG. 12, the brackets 24 of the tensioning modules 16 mate with corresponding slots on the buoy 10 to provide a secure attachment thereto. The crane 18 can now be disconnected from tether T5. The remaining tethers T6 to T8 are deployed in a similar fashion.

Figure 9:
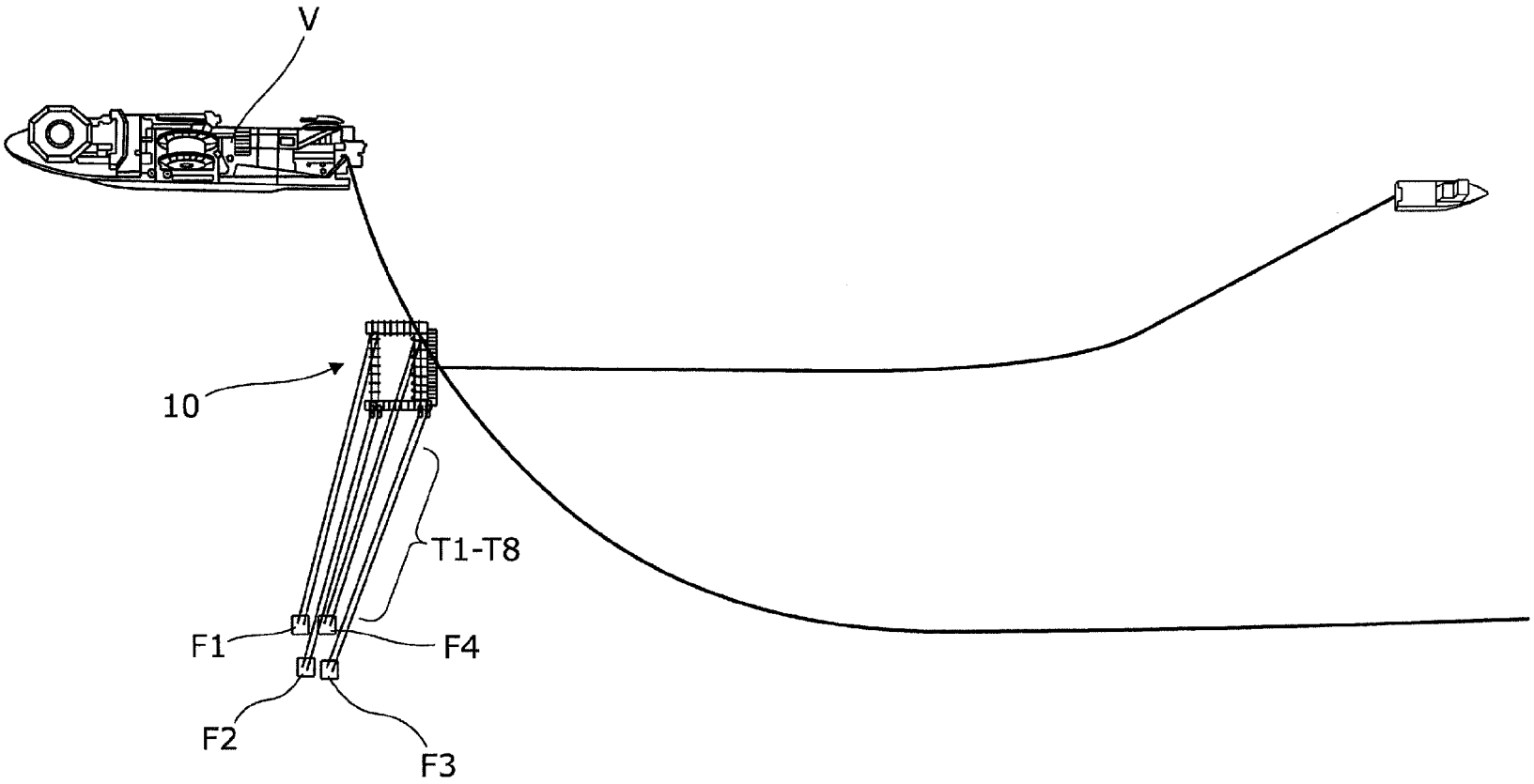
FIG. 9 is a schematic illustration of the fully tethered subsea buoy.

The tethers T1 to T8 are therefore deployed around the buoy 10 in pairs where there is a first tether (deployed in the first phase) and a second tether (deployed in the second phase) at each corner of the buoy 10. Although the second tether of each pair (tethers T5 to T8) will be relatively slack at this stage, all of the tethers T1 to T8 can subsequently be tensioned such that they hold the same or similar loads as each other, using a tensioning method described in detail below. As shown in FIG. 9, the buoy 10 is now secured to the foundations F1 to F4 via tethers T1 to T8.

Buoy Tether Tensioning

Most materials will undergo various phases of extension when subjected to a high degree of tension. Numerous different materials could be used for the presently described tethers; however, sheathed spiral strand wire is commonly available and is utilised in the presently described embodiment.

Whilst some extension characteristics are well known and easily predictable using testing, modelling and/or mathematical analysis, some extension characteristics are not accurately predictable. Although these may cause only small inaccuracies in a short length of wire, over longer lengths of say 2000 m, these inaccuracies are large enough to render the overall extension characteristics of the wire sufficiently unpredictable to require addressing. This problem is further compounded by thermal expansion and contraction, extension due to rotation, and extension due to wear of the wire.

Furthermore, the anchoring foundations may be at different depths from each other due to the undulation and/or slope of the sea bed.

It is therefore not sufficient to make the tethers T1 to T8 exactly the same length and assume that they will take equal shares of the load. To accommodate for this it is necessary to have some form of tension adjustment to ensure that each tether shares substantially the same load. The tensioning module 16 of the present invention provides this ability and will now be described in detail with particular reference to FIGS. 10 to 15. Operation of the tensioning module is described in the context of tensioning a subsea buoy to subsea foundations; however it could equally be used to tension other tethers and chains. For example, it could be used to tether a surface buoy to a subsea or surface structure, or to pull-in SCR's, umbilicals or flexible risers. Furthermore, the tensioning modules 16 could be used horizontally on the seabed for e.g. anchor pre-tensioning operations (where two opposing anchor spreads are tensioned against each other to pre-set the mooring by in-bedding drag-type anchors).

Tensioning module 16 comprises a support bracket 24, a tether holding arrangement in the form of chain stops 26, and a pivotable articulating member 28 supported in a pivotable support socket 30 attached to the support bracket 24. The pivotable articulating member provides a "ball" member and the support socket 30 provides a "socket" member of a "ball and socket" joint.

Figure 14:
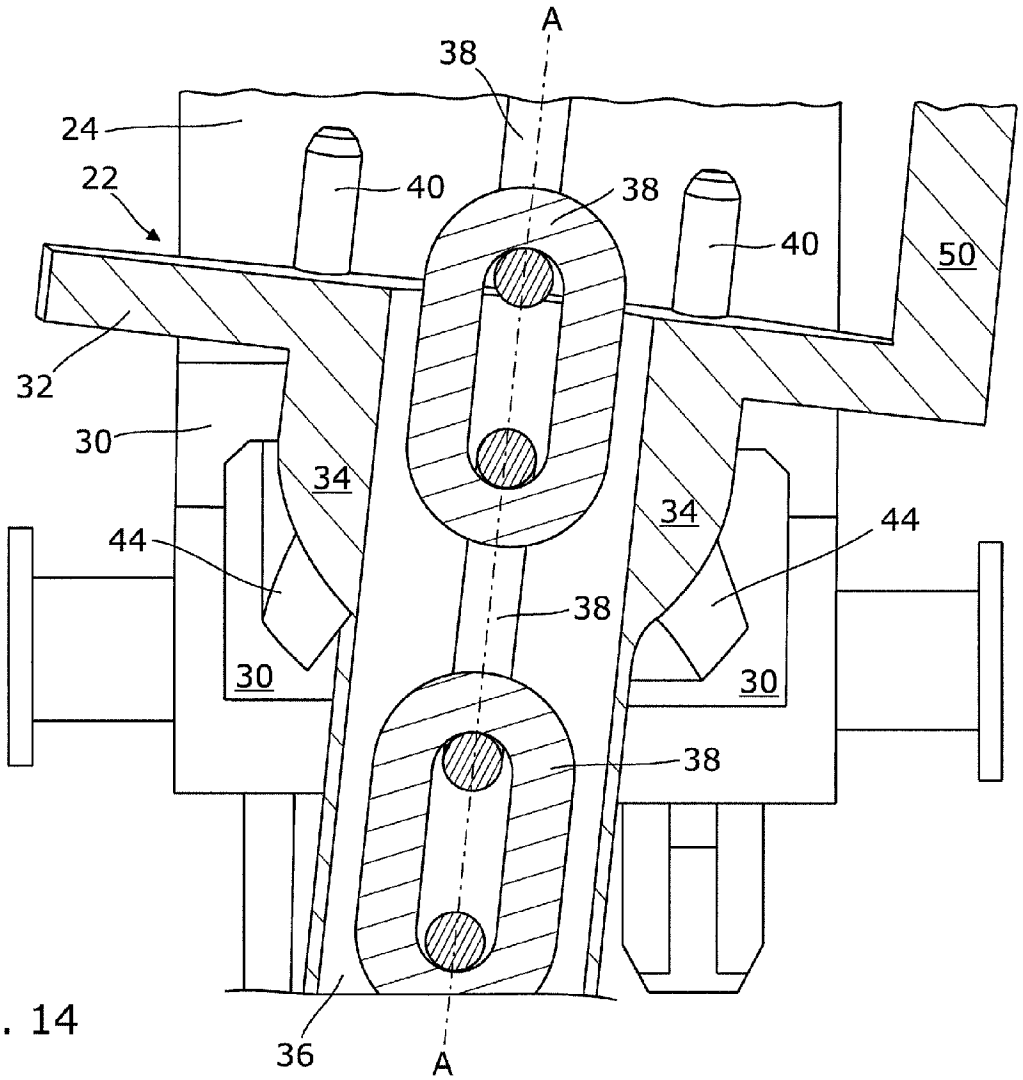
FIG. 14 is a detailed view of the ball and socket member of the tensioning apparatus of FIG. 13.
Figure 15:
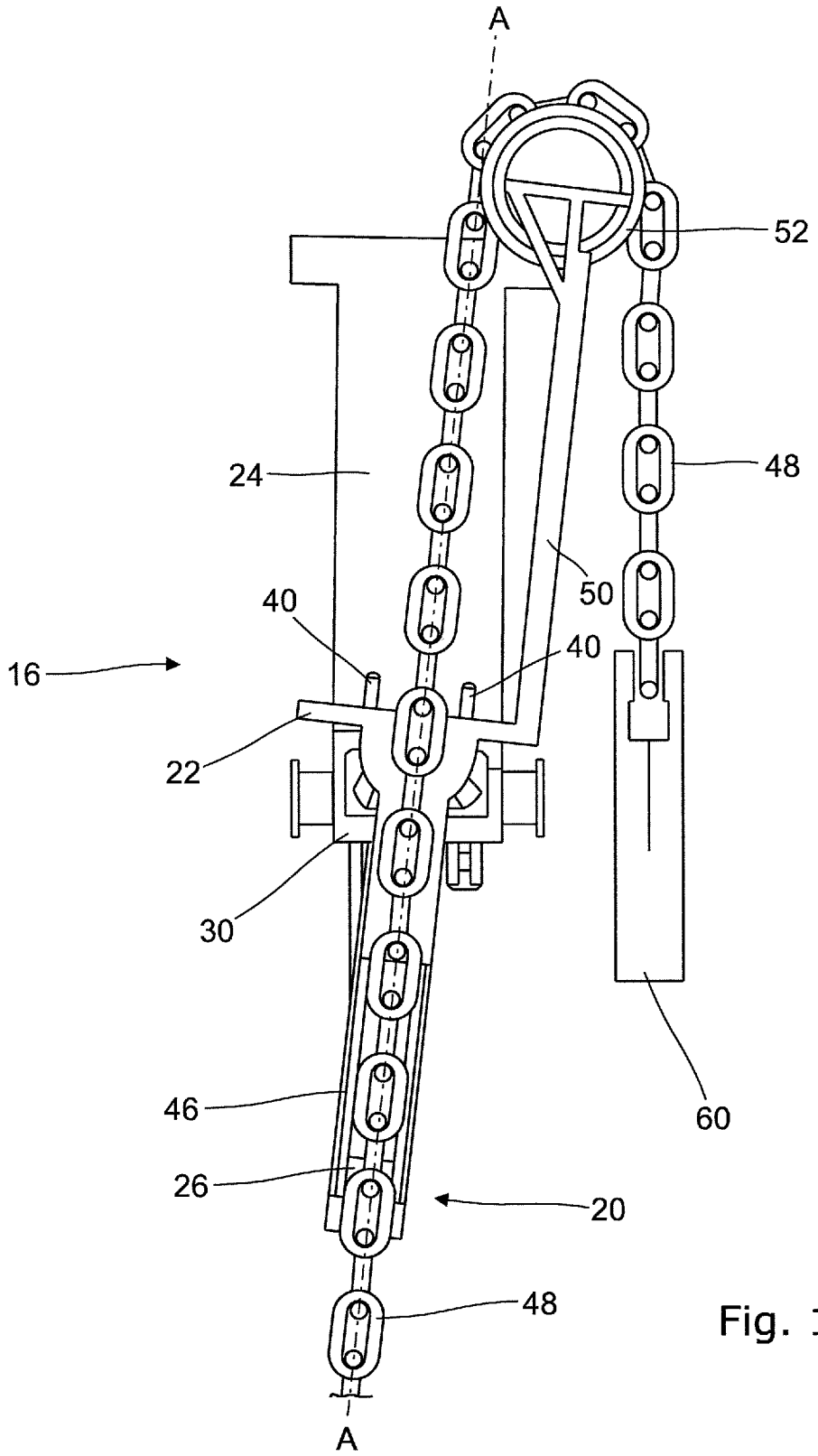
FIG. 15 is cross sectional side view of the tensioning apparatus.

The ball and socket joint is best illustrated in the cross section of FIG. 14. It comprises a ball member 22 having a top collar 32, a spherical portion 34, and an elongated lower section 36 having a channel therethrough which receives links 38 of a top chain 48 along a departure axis A-A (which is inclined in FIG. 14). The top collar 32 is provided with jack posts 40 which allow a linear jack 42 to be attached thereto.

The socket 30 supports the underside of the spherical portion 34 and is provided with removable bearing pads 44 which provide a bearing surface for the spherical portion 34. The bearing pads 44 and/or the bearing surface of the spherical portion 34 may comprise a high strength bearing material such as PTFE and/or fluoropolymer materials.

The bearing pads may comprise a laminated elastomer material having elastomer layers adhered with metal or composite inserts. This multilayer structure allows the mechanical characteristics of the joint to be adjusted during manufacture in order to suit the particular application. Such laminated elastomers meet the strictest technical specifications in terms of clearances, loads, pressure, operating conditions, environment and service life. In this regard, the size and hence the active bearing surface area between the spherical portion 34 and the socket 30/bearing pads 44 can be designed during manufacture to withstand a specific bearing pressure dependent on the bearing material chosen.

Referring to FIGS. 10 to 13 and FIG. 15, elongated guide members 46 are attached to the bottom of the ball member 22. These guide members 46 have a pair of chain stops 26 attached between their lower ends. The chain stops 26 together form a ratchet mechanism which engages with links 38 of a top chain 48 connected to a tether wire T (which may be any of tethers T1 to T8).

An upright arm 50 extends from the top collar 32 of the ball member 22 and ends with a chain bearing sheave 52. A dead weight 60 is attached to the free end of the top chain 48.

The linear jack 42 may be any linear jack capable of operating in a subsea environment and under such loading. In the presently described embodiment, the linear jack 42 has a pair of hydraulic pistons 54 connected to each other at their upper end by a plate 56 which has a pair of locking dogs 58 mounted thereon.

As previously described, the tethers T1 to T8 are connected in pairs on the buoy 10 (a pair at each of the four corners of the buoy 10). Although a linear jack 42 could be connected to every tensioning module 16, only one linear jack 42 need be provided for each pair, as shown in FIG. 12. Alternatively, a linear jack 42 and tensioning module 16 may be provided for each tether; this assists with equalisation of the tether loads since the tension held by one linear jack 42 of the pair can be readily compared with the tension held by the other linear jack 42 of the pair.

Each linear jack 42 is connected to a tensioning control manifold (not shown) which has hydraulic jumper hoses connected to the support vessel V. A subsea hydraulic power pack (not shown) may be mounted on the buoy 10 nearby the linear jacks 42. Alternative/addition electrical power may be supplied by cables from the surface vessel V. A hydraulic power pack can also be provided on an ROV adjacent the buoy 10 if required.

The tethers deployed in the second phase (tethers T5 to T8) need to match the tension of the tethers deployed in the first phase (tethers T1 to T4) in each pair. The relatively slack second tethers (T5 to T8) will therefore require tensioning up. This is achieved by stroking the linear jack 42 until the slack tether becomes sufficiently tensioned. In doing this, the locking dogs 58 are engaged with the top chain 48 and the pistons 54 of the linear jack 42 are extended. This causes the top chain 48 to be pulled in which therefore increases the tension on the attached tether T. The locking dogs 58 are then disengaged from the chain 48, the pistons 54 retracted, and the locking dogs 58 are then re-engaged at a lower point of the chain 48 ready for the next stroke. This is repeated in strokes of approximately two links until the required tension is achieved in the tether T. It is possible to monitor tension in the tether T using the linear jacks 42 by monitoring the hydraulic pressure on the jacks 42 themselves as they approach the predetermined required pressure and tether tension.

With the tether's T1 to T8 equally tensioned, the level (depth) and attitude (list and trim) of the buoy 10 can be assessed to determine if any adjustments are required. If adjustments are required, corners of the buoy 10 can be lowered or raised in the water by stroking the linear jacks 42 by incremental amounts until the desired positioning is achieved.

Once the final position and orientation of the buoy 10 is achieved, the hydraulic force provided by the linear jacks 42 is relaxed in order to gradually transfer the load onto the chain stops 26. With the load held by the chain stops 26, the linear jacks 42 can be disengaged from the top chain 48.

Figure 10:
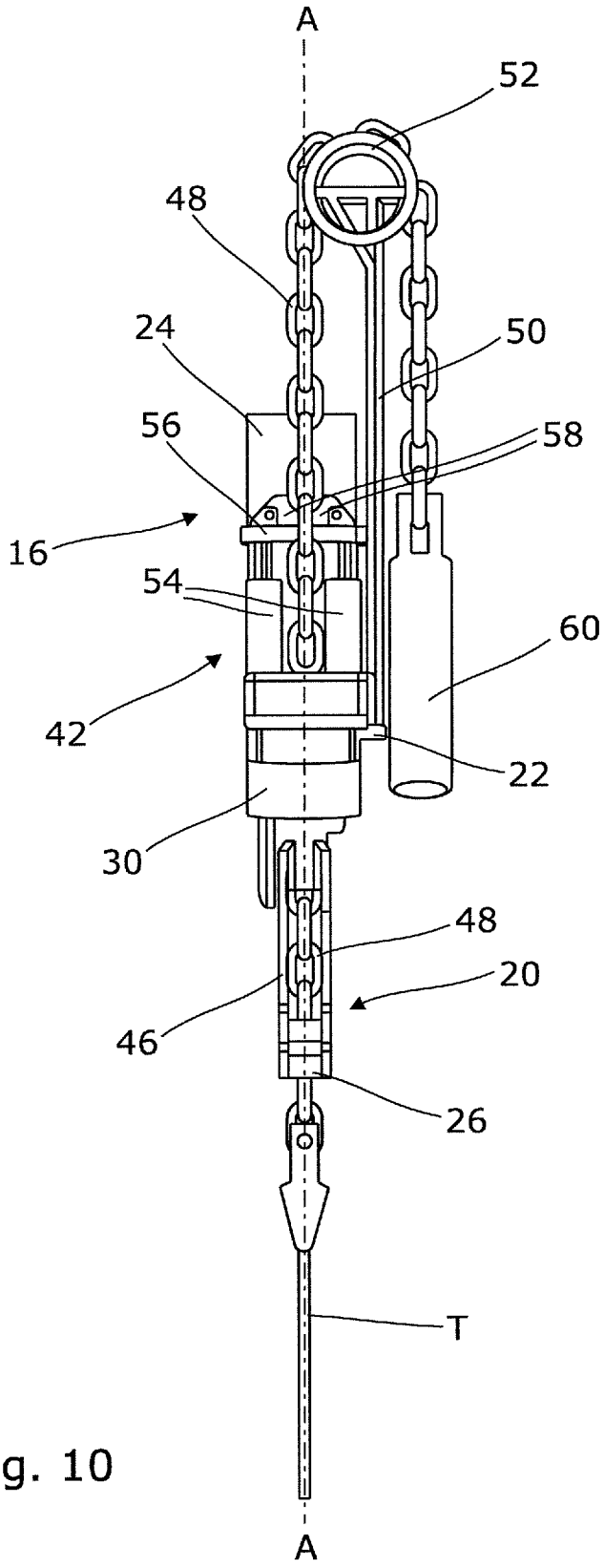
FIG. 10 is a front view of tensioning apparatus according to a second aspect of the invention.
Figure 11:
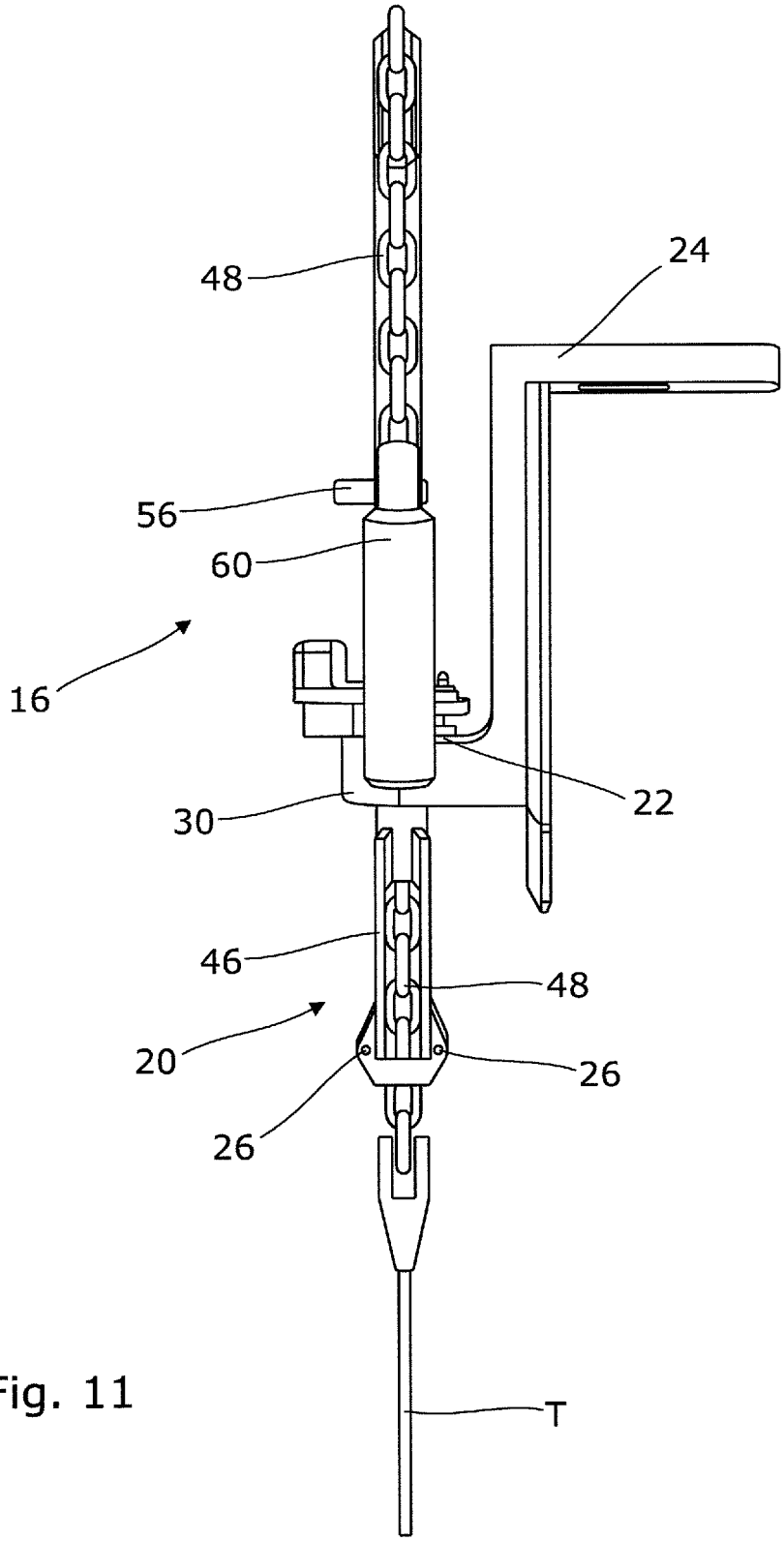
FIG. 11 is a side view of the tensioning apparatus of FIG. 10.

If the buoy 10 floats directly above the anchoring foundations F1 to F4 the departure axis A-A of the tethers T1 to T8 will be substantially vertical. This situation is depicted in FIGS. 10 and 11. However, due to currents within the water, during the operational lifetime of the system (and during the abovementioned tensioning adjustments), the buoy 10 will typically not float directly above the foundations F1 to F4. Instead, the buoy 10 and attached tethers T1 to T8 will normally drift away from such alignment such that the departure axes A-A of the tethers T1 to T8 are inclined relative to the floating plane of the buoy 10. This situation is depicted in FIGS. 12 to 15.

The ball and socket arrangement incorporated into the tensioning apparatus of the present invention allows the tensioning apparatus to adjust position in reaction to such inclinations of the departure axis A-A, as described subsequently.

At the buoy end of each tether, the tension load on the tether is held by the engagement between the chain stops 26 and the links 38 of the top chain 48 as previously described. Because the chain stops 26 are provided at the bottom of the elongated guide members 46 any change in inclination of the tether T (due to e.g. a change in water current imparted on the buoy 10) will cause the ball member 22 to correspondingly pivot and swivel in the socket 30. The distance between the chain stops 26 and the ball and socket joint provides a greater moment arm to facilitate such movement. This is desirable since the frictional force between the spherical portion 34 of the ball member 22 and the pads 44 of the socket 30 will be high in view of the magnitude of tension load in the tethers T.

This movement of the ball member 22 maintains the apparatus in line with the tether departure axis A-A which thereby ensures that all parts of the top chain 48 are under tension only. There is no kink or bend in the top chain 48 to cause localised overloading or wear over time. The only part of the top chain 48 which is not aligned with the departure axis A-A is the very top end of the top chain 48 that passes over the sheave 52; however this is not subjected to the tension of the tether T due to the retaining action of the chain stops 26.

Once the above tensioning adjustments have been made, some predetermined compartments of the buoy 10 may be de-ballasted until the spare buoyancy (net up thrust) is equal, or near to equal, in each corner of the buoy 10. This can be achieved by connecting down nitrogen hoses from the support vessel V to an "installation ballasting manifold".

Each linear jack 42 is then moved up approximately half a chain link to take the load off the chain stoppers 26 and lock the hydraulic pressure in the linear jacks 42 (to monitor tension in all the tethers T). Pumping of an inert gas, such as nitrogen, into designated compartments is then commenced in stages while monitoring the increase of tension in the tethers T. With the tethers T approaching nominal tension, load sharing and attitude of the buoy 10 is monitored. If required individual tethers can be adjusted for better load sharing prior to fully de-ballasting of the buoy 10. The buoy 10 is then de-ballasted until all designated compartments have been emptied. The total measured tether tension is then compared to the actual intended tension. If requirements are met, then all valves on the de-ballasted compartments are closed and the ballasting down lines are disconnected.

The buoy 10 is now ballasted to nominal operational upthrust conditions. The buoy 10 depth and attitude can now be finally adjusted and the tether loads optimised as follows:—

Ensure all linear jacks 42 are carrying the tether loads, i.e. chain stoppers 26 are not engaged; assess depth of the buoy 10 to determine if requirements are to raise or lower the buoy 10; assess trim and list to determine if adjustment of the buoy 10 is required; check individual load sharing at each corner of the buoy 10 and adjust tethers T as required to equalise tension between the tethers T; when complete, relax the linear jacks 42 until the chains 48 are locked-off in chain stoppers 26 and pressure is off the linear jacks 42; recover hydraulic down line, manifold and linear jacks 42.

The described system therefore provides an improved method of deploying subsea buoys to an appropriate depth and ensuring they are maintained at that depth regardless of varying degrees of tether extension. Furthermore, the ability of the tensioning apparatus to articulate with changes in tether angle helps to minimise the risk of excessive force on the tethers adjacent the connections with the buoy which can therefore improve the reliability and service lifetime of the tethers and buoy.

Modifications and improvement may be made to foregoing without departing from the scope of the invention, for example:—

Although, eight tethers in total are used in the embodiment described, the method and apparatus is equally suitable for tethering a buoy using more or less tethers. For example, three or six tethers could be used on a triangular buoy.

In the embodiment described, the tensioning modules 16 are mainly used to tension buoy tethers. However, the tensioning modules 16 could be used to tension any elongate member with minimal or no modification. For example, they could be used to pre-tension pipelines laid on the seabed where the pipeline itself comprises a tether. This would be useful to prevent "pipeline walking" (where the thermal expansion and contraction cycle of the pipeline coupled with the topography of the seabed makes such installations prone to an incremental ratcheting movement down the slope of the seabed).

The invention claimed is:

1. A method of installing a production buoy to subsea anchoring foundations, the method comprising, in order, the steps of:

floating a production buoy over the subsea anchoring foundations;

hanging at least one tether off the production buoy such that the or each tether extends from the production buoy towards the subsea anchoring foundations;

submerging the production buoy to a connection depth which allows connection of the or each tether to the subsea anchoring foundations; and connecting the or each tether to the subsea anchoring foundation beneath the buoy.

2. The method as claimed in claim 1, further comprising the step of submerging the production buoy to a first predetermined depth prior to hanging the or each tether off the production buoy.

3. The method as claimed in claim 1, wherein the step of submerging the production buoy comprises suspending a chain with clump weights from a pair of vessels attached to either side of the production buoy.

4. The method as claimed in claim 1, wherein the production buoy comprises a square or rectangular shape and four tethers are hung off the production buoy, one at each corner of the production buoy.

5. The method as claimed in claim 1, wherein the production buoy comprises a triangular shape and three tethers are hung off the production buoy, one at each corner of the production buoy.

6. The method as claimed in claim 1, wherein the step of securing the or each tether to the subsea anchoring foundations comprises tilting the production buoy to one side in order to secure a pair of tethers at the one side of the production buoy to corresponding subsea anchoring foundations at the one side of the production buoy, and then tilting the production buoy to an other side in order to secure a pair of tethers at the other side of the production buoy to corresponding subsea anchoring foundations at the other side of the production buoy.

7. The method as claimed in claim 6, wherein the step of tilting the production buoy is performed by lowering a chain and clump weights from a vessel attached to one side of the production buoy and then by lowering a chain and clump weights from another vessel attached to the other side of the production buoy.

8. The method as claimed in claim 6, wherein the step of tilting the buoy is performed by selective flooding of ballast compartments within the buoy.

9. The method as claimed in claim 1, wherein the method further comprises attaching the production buoy to the subsea anchoring foundations with at least a further tether.

10. The method as claimed in claim 9, wherein the method comprises attaching the production buoy to the subsea anchoring foundations with a further four tethers for a square or rectangular buoy or with a further three tethers for a triangular buoy.

11. The method as claimed in claim 9, wherein the step of attaching the production buoy to the subsea anchoring foundations with at least a further tether comprises lowering the or each further tether until the lower end of the or each further tether is adjacent the subsea anchoring foundations, and an attachment portion, toward the upper end of the or each further tether is adjacent the production buoy, and then attaching the lower end to the subsea anchoring foundations and the attachment portion to the production buoy.

12. The method as claimed in claim 11, wherein the step of lowering includes lowering the or each further tether from a crane provided on a support vessel.

13. The method as claimed in claim 3, wherein the production buoy comprises a triangular shape and three tethers are hung off the production buoy, one at each corner of the production buoy.

14. The method as claimed in claim 10, wherein the step of attaching the production buoy to the subsea anchoring foundations with at least a further tether comprises lowering the or each further tether until the lower end of the or each further tether is adjacent the subsea anchoring foundations, and an attachment portion, toward the upper end of the or each further tether is adjacent the production buoy, and then attaching the lower end to the subsea anchoring foundations and the attachment portion to the production buoy.

* * * * *